US006819308B2

(12) United States Patent
Cheng

(10) Patent No.: US 6,819,308 B2
(45) Date of Patent: Nov. 16, 2004

(54) ENERGY EFFICIENT GREY SCALE DRIVER FOR ELECTROLUMINESCENT DISPLAYS

(75) Inventor: Chun-Fai Cheng, Ontario (CA)

(73) Assignee: iFire Technology, Inc., Fort Saskatchewan (CA)

( * ) Notice: Subject to any disclaimer, the term of this patent is extended or adjusted under 35 U.S.C. 154(b) by 304 days.

(21) Appl. No.: 10/036,002

(22) Filed: Dec. 26, 2001

(65) Prior Publication Data

US 2003/0117421 A1 Jun. 26, 2003

(51) Int. Cl.[7] ..... G09G 3/30
(52) U.S. Cl. ..... 345/76; 345/211; 345/212
(58) Field of Search ..... 345/76, 77, 211–214; 315/169.3, 224; 313/498

(56) References Cited

U.S. PATENT DOCUMENTS

| | | | | |
|---|---|---|---|---|
| 3,749,977 A | | 7/1973 | Sliker | |
| 4,349,816 A | | 9/1982 | Miller et al. | |
| 4,574,342 A | | 3/1986 | Runyan | |
| 4,633,141 A | | 12/1986 | Weber | |
| 4,707,692 A | | 11/1987 | Higgins et al. | |
| 4,866,349 A | | 9/1989 | Weber et al. | |
| 5,027,040 A | | 6/1991 | Ideda et al. | |
| 5,293,098 A | | 3/1994 | Brawnell | |
| 5,315,311 A | | 5/1994 | Honkala | |
| 5,432,015 A | | 7/1995 | Wu et al. | |
| 5,440,208 A | | 8/1995 | Uskali et al. | |
| 5,517,089 A | | 5/1996 | Ravid | |
| 5,559,402 A | | 9/1996 | Corrigan, III | |
| 5,566,064 A | | 10/1996 | Schoenwald et al. | |
| 5,576,601 A | | 11/1996 | Koenck et al. | |
| 5,754,064 A | | 5/1998 | Chien | |
| 5,793,342 A | | 8/1998 | Rhoads | |
| 5,812,104 A | * | 9/1998 | Kapoor et al. | 345/76 |
| 6,016,257 A | * | 1/2000 | Chang et al. | 363/17 |
| 6,317,338 B1 | | 11/2001 | Boys | |
| 6,421,034 B1 | * | 7/2002 | Mihara | 345/76 |
| 6,448,950 B1 | * | 9/2002 | Cheng | 345/76 |

FOREIGN PATENT DOCUMENTS

JP 11067447 3/1999

OTHER PUBLICATIONS

King, Christopher N., "EL Displays", SID International Symposium Lecture Notes 1992, May 18, 1992, vol. 1, Lecture No. 6.

* cited by examiner

*Primary Examiner*—Regina Liang
(74) *Attorney, Agent, or Firm*—Fay, Sharpe, Fagan, Minnich & McKee, LLP

(57) ABSTRACT

A circuit and method are provided for driving a display panel requiring gray scale control wherein the voltage applied to a row of pixels is equal to the sum of voltages of opposite sign with respect to ground applied respectively to the row electrode and column electrodes whose intersection with the row defines the pixels. The pixels have a capacitance that may be voltage dependent such that energy is stored in the pixels when a voltage is applied across them. The driving circuit incorporates a resonant circuit that is able to efficiently recover capacitive energy stored on the row of pixels and transfer it to another row of pixels. The resonant circuit comprises a step down transformer, a capacitor across the primary winding, either the rows or columns of the display panel connected across the secondary winding and an input voltage and FET switches to drive the resonant circuit synchronous with the timing pulses governing the addressing of the display. An additional secondary winding is provided on the transformer that is connected to a rectifier and DC storage capacitor that is connected in series with the rows of columns of the panel. The additional circuit facilitates clamping of the driver voltage to a constant level irrespective of variations in the load due to the fluctuations in load impedance.

32 Claims, 10 Drawing Sheets

PRIOR ART

Waveform distortion due to resonant frequency too high

Waveform distortion due to resonant frequency too low

Row drive polarity switch output showing +ve and -ve display cycle (6 lines per frame shown)

ENERGY EFFICIENT GREY SCALE DRIVER FOR ELECTROLUMINESCENT DISPLAYS

FIELD OF THE INVENTION

The present invention relates generally to flat panel displays, and more particularly to a resonant switching panel driving circuit where the panel imposes a variable high capacitive load on the driving circuit and where the driving voltage must be regulated to facilitate gray scale control.

BRIEF DESCRIPTION OF THE DRAWINGS

The Background of the Invention and Detailed Description of the Preferred Embodiment are set forth herein below with reference to the following drawings, in which.

BACKGROUND OF THE INVENTION

Electroluminescent displays are advantageous by virtue of their low operating voltage with respect to cathode ray tubes, their superior image quality, wide viewing angle and fast response time over liquid crystal displays, and their superior gray scale capability and thinner profile than plasma display panels. They do have relatively high power consumption, however, due to the inefficiencies of pixel charging, as discussed in greater detail below. This is the case even though the conversion of electrical energy to light within the pixels is relatively efficient. However, the disadvantage of high power consumption associated with electroluminescent displays can be mitigated if the capacitive energy stored in the electroluminescent pixels is efficiently recovered.

The present invention relates to energy efficient methods and circuits for driving display panels where the panel imposes a variable capacitive load on the driving circuit and where the driving voltage must be regulated to facilitate gray scale control. The invention is particularly useful for electroluminescent displays where the panel capacitance is high. The panel capacitance is the capacitance as seen on the row and column pins of the display. Electroluminescent display pixels have the characteristic that the pixel luminance is zero if the voltage across the pixel is below a defined threshold voltage, and becomes progressively greater as the voltage is increased beyond the threshold voltage. This property facilitates the use of matrix addressing to generate a video image on the display panel.

Figure 1:
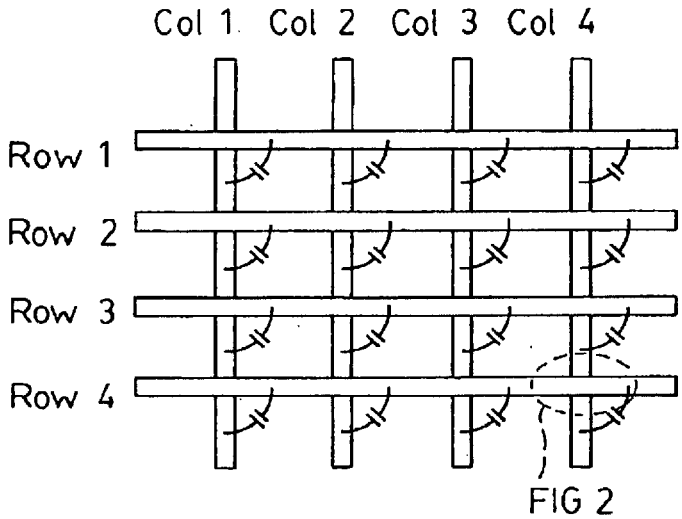
FIG. 1 is a plan view of an arrangement of rows and columns of pixels on an electroluminescent display, in accordance with the Prior Art.
Figure 2:
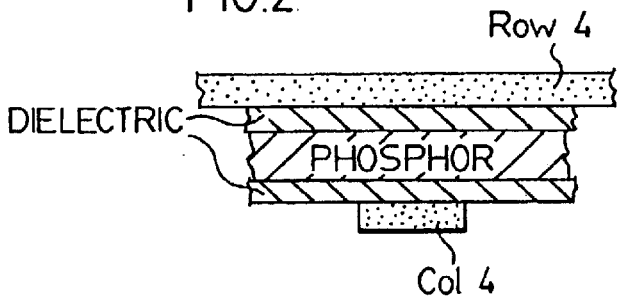
PRIOR ART FIG.2
FIG. 2 is a cross section through a single pixel of the electroluminescent display of FIG. 1.

As shown in FIGS. 1 and 2, an electroluminescent display has two intersecting sets of parallel electrically conductive address lines called rows (ROW 1, ROW 2, etc.) and columns (COL 1, COL 2, etc.) that are disposed on either side of a phosphor film encapsulated between two dielectric films. A pixel is defined as the intersection point between a row and a column. Thus, FIG. 2 is a cross-sectional view through the pixel at the intersection of ROW 4 and COL 4, in FIG. 1. Each pixel is illuminated by the application of a voltage across the intersection of row and column. Matrix addressing entails applying a voltage below the threshold voltage to a row while simultaneously applying voltages of the opposite polarity to each column that intersects that row. The opposite polarity voltage augments the row voltage in accordance with the illumination desired on the respective pixels, resulting in generation of one line of the image. An alternate scheme is to apply the maximum pixel voltage to a row and apply column voltages of the same polarity to all columns with a magnitude up to the difference between the maximum voltage and the threshold voltage, in order to decrease the pixel voltages in accordance with the desired image. In either case, once each row is addressed, another row is addressed in a similar manner until all of the rows have been addressed. Rows not being addressed are left at open circuit. The sequential addressing of all rows constitutes a complete frame. Typically, a new frame is addressed at least about 50 times per second to generate what appears to the human eye as a flicker-free video image.

When each row of an electroluminescent display is illuminated, a portion of the energy supplied to the illuminated pixels is dissipated as current flows through the pixel phosphor layer to generate light, but a portion remains stored on the pixel once light emission has ceased. This residual energy remains on the pixel for the duration of the applied voltage pulse, and typically represents a significant fraction of the energy supplied to the pixel.

Figure 3:
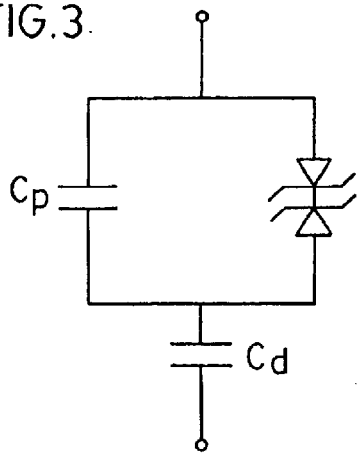
PRIOR ART FIG.3
FIG. 3 is an equivalent circuit for the pixel of FIG. 2.

FIG. 3 is an equivalent circuit which models the electrical properties of the pixel. The circuit comprises two back-to-back Zener diodes with a series capacitor labeled $C_d$ and a parallel capacitor labeled $C_p$. Physically, the phosphor and dielectric films (FIG. 2) are both insulators below the threshold voltage. This is represented in FIG. 3 by the situation where one Zener diode is not conducting so that the pixel capacitance is the capacitance of the series combination of the two capacitors $C_d$ and $C_p$. Above the threshold voltage, the phosphor film becomes conductive, corresponding to the situation where both Zener diodes are conducting such that the pixel capacitance is equal to that of the series capacitor only. Thus, the pixel capacitance is dependent on whether the voltage is above or below the threshold voltage. Further, because all of the pixels on the display are coupled to one another through the rows and columns, all of the pixels on the panel may be at least partially charged when a single row is illuminated. The extent of the partial charging of the pixels on non-illuminated rows is highly dependent on the variability of the simultaneous column voltages. In the case where all column voltages are the same, no partial charging of the pixels on non-illuminated rows occurs. In the case where about half of the columns have little or no applied voltage and the remaining half have close to the maximum voltage, the partial charging is most severe. The latter situation arises frequently in presentation of video images. The energy associated with this partial charging is typically much greater than the energy stored in the illuminated row, especially if there are a large number of rows, as in a high-resolution panel. All of the energy stored in non-illuminated rows is potentially recoverable, and may amount to more than 90% of the energy stored in the pixels, particularly for panels with a large number of rows.

Another factor contributing to energy consumption is the energy dissipated in the resistance of the driving circuit and the rows and columns during charging of the pixels. This dissipated energy may be comparable in magnitude to the energy stored in the pixels if the pixels are charged at a constant voltage. In this case, there is an initial high current surge as the pixels begin to charge. It is during this period of high current that most of the energy is dissipated since the dissipation power is proportional to the square of the current. Making the current that flows during pixel charging closer to a constant current can reduce the dissipated energy. This has been addressed, for example by C. King in SID International Symposium Lecture Notes 1992, May 18, 1992, Volume 1, Lecture no. 6, through the application of a stepped voltage pulse rather than a single square voltage pulse as is done conventionally in the electroluminescent display art. However, the circuitry required to provide stepped pulses adds to complexity and cost.

Sinusoidal driving waveforms have also been employed to reduce resistive energy loss. U.S. Pat. No. 4,574,342 teaches the use of a sinusoidal supply voltage generated using a DC to AC inverter and a resonant tank circuit to drive an electroluminescent display panel. The panel is connected in parallel with the capacitance of the tank circuit. The supply voltage is synchronized with the tank circuit so as to maintain the voltage amplitude in the tank at a constant level independent of the load associated with the panel. The use of the sinusoidal driving voltage eliminates high peak currents associated with constant voltage driving pulses and therefore reduces $I^2R$ losses associated with the peak current, but does not effect recovery of capacitive energy stored in the panel.

U.S. Pat. No. 4,707,692 teaches the use of an inductor in parallel with the capacitance of the panel to effect partial energy recovery. This scheme requires a large inductor to achieve a resonance frequency commensurate with the timing constraints inherent in display operation, and does not allow for efficient energy recovery over a wide range of panel capacitance, which, as discussed above is commonly encountered with electroluminescent displays. U.S. Pat. No. 5,559,402 teaches a similar inductor switching scheme by which two small inductors and a capacitor which are external to the panel sequentially release small energy portions to the panel or accept small energy portions from the panel. However, only a portion of the stored energy can be recovered. U.S. Pat. No. 4,349,816 teaches energy recovery by means of incorporating the display panel into a capacitive voltage divider circuit that employs large external capacitors to store recovered energy from the panel. This scheme increases the capacitive load on the driver which, in turn, increases the load current and increases resistive losses. None of these three patents teaches reduction of resistive losses by using sinusoidal drivers.

U.S. Pat. Nos. 4,633,141; 5,027,040; 5,293,098; 5,440,208 and 5,566,064 teach the use of resonant sinusoidal driving voltages to operate an electroluminescent lamp element and recover a portion of the capacitive energy in the lamp element. However, these schemes do not facilitate efficient energy recovery when there is a large random short-term variation in the panel capacitance. In fact, accommodation of such capacitance changes is not a requirement for the operation of electroluminescent lamps where the panel capacitance is fixed, other than to compensate for slow changes due to the aging characteristics of the panel.

U.S. Pat. No. 5,315,311 teaches a method of saving power in an electroluminescent display. This method involves sensing when the power demand from the column drivers is highest in a situation where the pixel voltage is the sum of the row and column voltages, and then reducing the column voltage, and correspondingly increasing the selected row voltage. The method does not facilitate reduction of resistive losses by limiting peak currents, nor does it recover capacitive energy from the panel. Research suggests that the method of this patent degrades the contrast ratio for the display, since any pixels in the selected row that are meant to be off will be somewhat illuminated due to the row voltage being somewhat above the threshold voltage. Thus, this prior art power saving method does not work well in conjunction with gray scale capability.

According to co-pending U.S. patent application Ser. No. 09/504,472 an electroluminescent display driving method and circuit are provided that simultaneously recover and re-use the stored capacitive energy in a display panel and minimize resistive losses attributable to high instantaneous currents. These features improve the energy efficiency of the panel and driver circuit, thereby reducing their combined power consumption. Also, by reducing the rate of heat dissipation in the display panel and driver circuit the panel pixels can be driven at higher voltage and higher refresh rates, thereby increasing brightness. An additional benefit of applicant's prior invention is reduced electromagnetic interference due to the use of a sinusoidal drive voltage rather than a pulse drive voltage. The use of a sinusoidal drive voltage eliminates the high frequency harmonics associated with discrete pulses. The advantages given above are accomplished without the need for expensive high voltage DC/DC converters.

The energy efficiency of the display panel and driving circuit of U.S. patent application Ser. No. 09/504,472 is improved through the use of two resonant circuits to generate two sinusoidal voltages, one to power the display rows and one to power the display columns. The row capacitance, as seen on the row pins of the display, forms one element of the resonant circuit for the row driving circuit. The column capacitance, as seen on the column pins of the display, forms one element of the resonant circuit for the column driving circuit.

The energy in each resonant circuit is periodically transferred back and forth between capacitive elements and inductive elements. The resonant frequency of each of the resonant circuits is tuned so that the period of the oscillations is matched as closely as possible, i.e. synchronized, to the charging of successive panel rows at the scanning frequency of the display.

When the energy is stored inductively, a switch that connects the row resonant circuit to a particular row is activated so as to direct the energy stored inductively to the appropriate row as the rows are addressed in sequence. The row driving circuit for the rows also includes a polarity reversing circuit that reverses the row voltage on alternate frames in order to extend the service life of the display.

In a similar manner, the column driving circuit connects the column resonant circuit to all of the columns simultaneously so as to direct energy stored inductively to the columns. The column switches, as is taught in the conventional art, also serve to control the quantity of energy fed to each column in order to effect gray scale control. Typically, the row switches and column switches are packaged as an integrated circuit in sets of 32 or 64 and are respectively called row drivers and column drivers.

Figure 4:
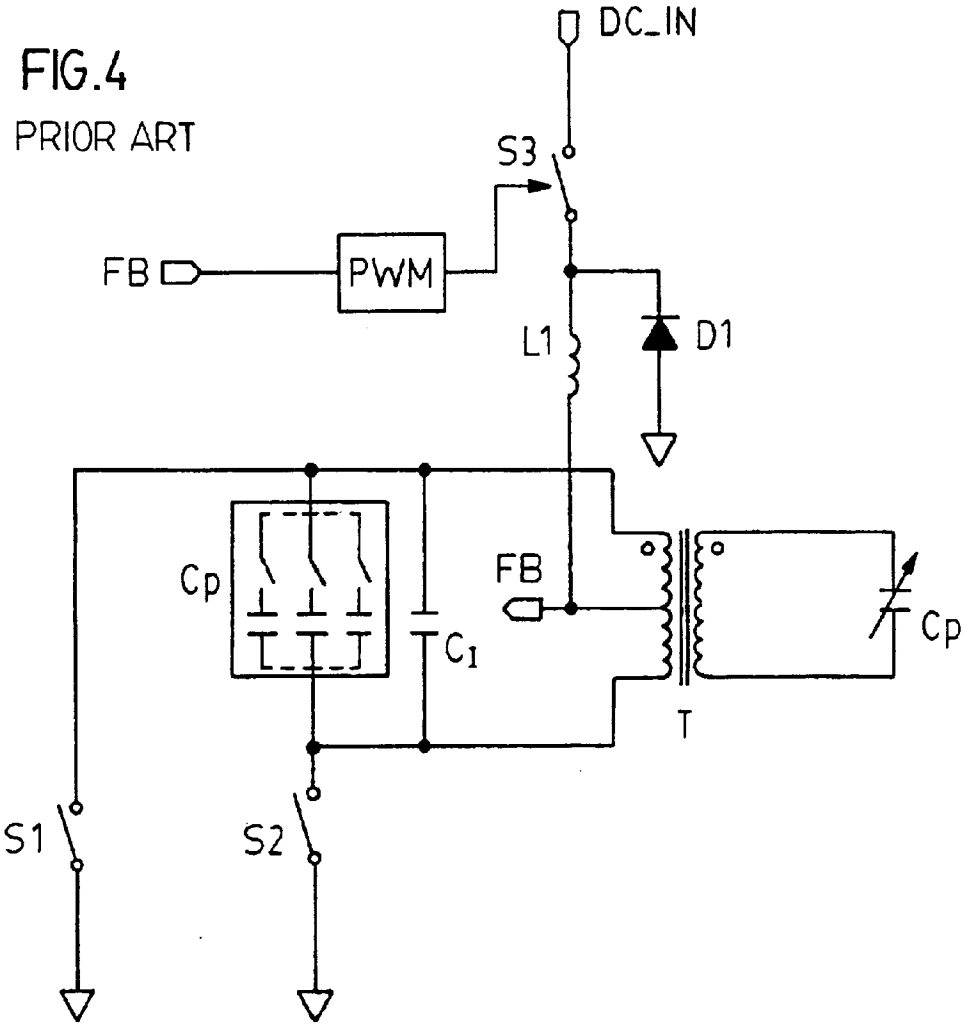
FIG.4 PRIOR ART
FIG. 4 is a simplified circuit schematic of a resonant circuit used in the display driver according to Applicant's earlier filed U.S. patent application Ser. No. 09/504,472.

FIG. 4 is a simplified schematic of a resonant circuit according to U.S. patent application Ser. No. 09/504,472. The basic element is a resonant voltage inverter forming a resonant tank that comprises a step down transformer (T), a capacitance corresponding to the panel capacitance ($C_p$) connected across the secondary winding of the transformer and a further capacitance ($C_I$) connected across the primary winding of the transformer. The further capacitance may optionally include a further bank of capacitors ($C_f$) that can be selected to synchronize the resonant frequency with different display scanning frequencies.

The resonant circuit also comprises two switches ($S_1$ and $S_2$) that alternately open and close when the current is zero in order to invert an incoming sinusoidal signal to a unipolar resonant oscillation. An input DC voltage is chopped by switch ($S_3$) under control of a pulse width modulator (PWM) to control the voltage amplitude of the resonant oscillation. To stabilize the voltage of the oscillations, a signal (FB) is fed back from the primary of the transformer to the PWM to adjust the on-to-off time ratio for the switch ($S_3$) in response to fluctuations in the voltage on the secondary. This feedback compensates for voltage changes due to variations in the panel impedance resulting, in turn, from changes in the displayed image. The panel impedance is the impedance as seen on the row and column pins of the display.

To operate efficiently, the resonant frequency of the driving circuit must not vary appreciably so that the resonant frequency remains closely matched to the frequency of row addressing timing pulses. The resonant frequency f is given by equation 1

$$f=1/(2\pi(LC)^{1/2}) \quad (1)$$

where L is the inductance and C is the capacitance of the tank in the resonant circuit. The resonant circuit must account for the variability in the panel capacitance that contributes to the total tank capacitance. This is accomplished by use of the step down transformer which reduces the contribution of the panel capacitance ($C_p$) to the tank capacitance so that the effective tank capacitance C is given by equation 2 where, $C_P$ is the panel capacitance, $C_I$ is the value of the capacitance across the primary winding of the transformer and $n_1$ and $n_2$ are the number of turns respectively on the primary and secondary windings of the transformer.

$$C=(n_2/n_1)^2C_p+C_I \quad (2)$$

Figure 5A:
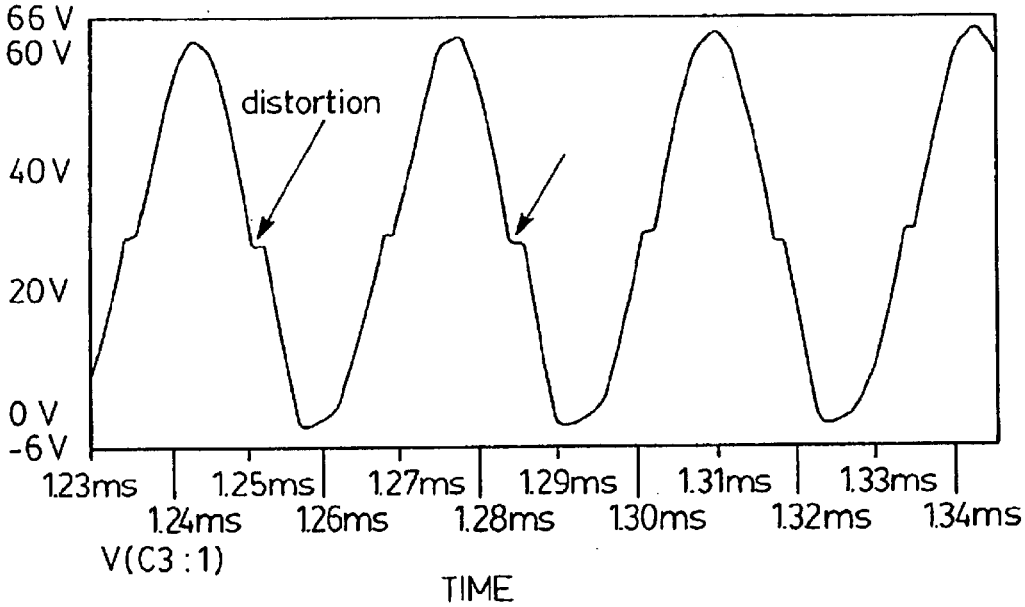
FIG.5a. PRIOR ART
FIGS. 5A–5C are oscilloscope tracings that show waveforms for the resonant circuit of FIG. 4 under different conditions.
Figure 5B:
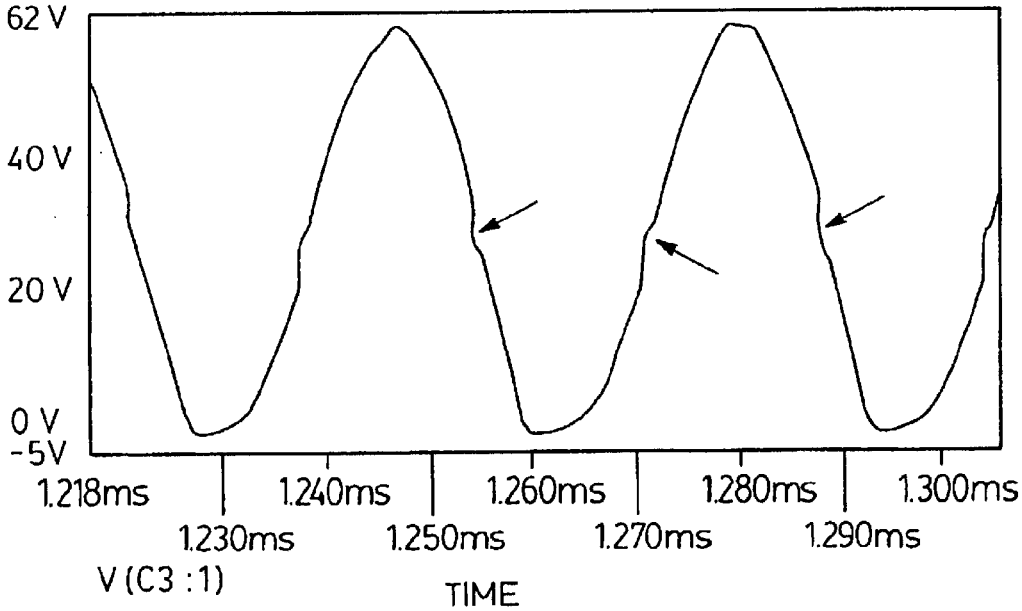
FIG.5b. PRIOR ART
Figure 5C:
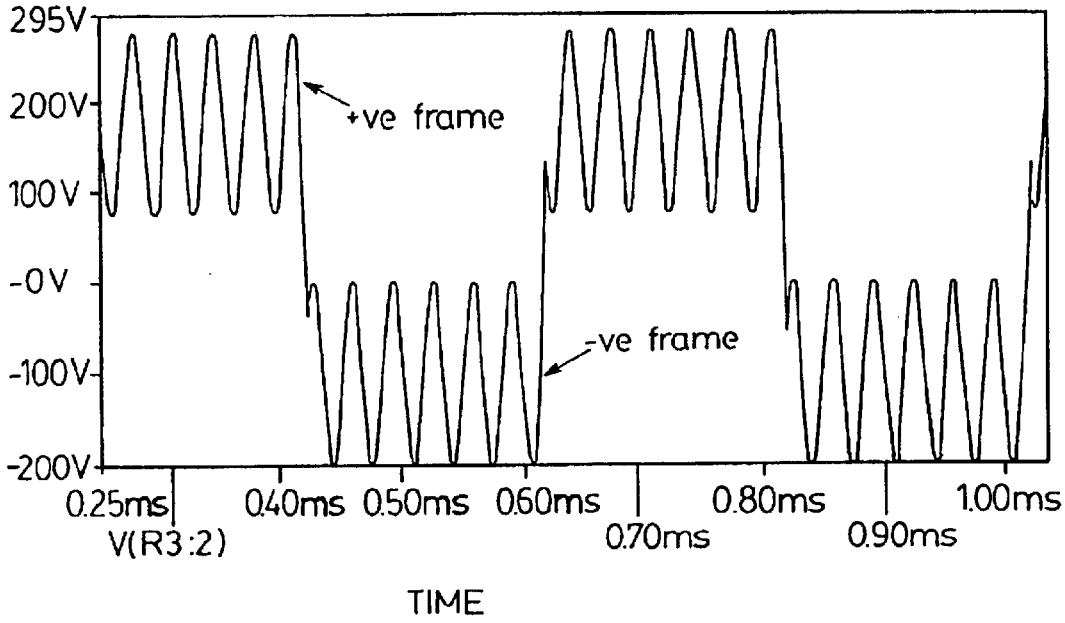
FIG. 5c. PRIOR ART

Values for the ratio of the number of turns ($n_2/n_1$) and $C_I$ are chosen so that the first term in equation 2 is small compared with the second term. Equation 2 is used as a guide in determining appropriate values for the turns-ratio and the primary capacitance for a particular panel, and mutual optimization of these values is then accomplished by examining the voltage waveforms measured at the output of the resonant circuit. Component values are then selected to minimize the deviation from a sinusoidal signal. If the resonant frequency is too high, a waveform exemplified by that shown in FIG. 5A will be observed where there is a zero voltage interval between the alternate polarity segments of the waveform. Appropriate adjustments are then made using equations 1 and 2 as a guide. If the resonant frequency is too low, a waveform exemplified by that shown in FIG. 5B will be observed, where there is a vertical voltage step crossing zero volts connecting alternate polarity segments of the waveform. If the resonant frequency is well matched to the row addressing frequency, a nearly perfect sinusoidal waveform will be observed, as shown in FIG. 5C. However, in practice, fluctuations in the load will result in small frequency variations. Therefore, the DC input switching is usually set so that fluctuations in resonant frequency result in the resonant frequency being equal to or higher than the switching frequency so that deviations from the ideal resonant frequency result in the waveforms shown in FIG. 5A. This is to avoid large current transients associated with the abrupt voltage changes at the switching point as shown in FIG. 5B. Large transient currents decrease the energy efficiency of the circuit by increasing ohmic loss.

The known prior art is absent any teaching of voltage regulation of a flat panel display which accommodates variations in load during scanning which occur at a rate faster than the time constant for the feedback circuit to correct, thereby resulting in image artifacts.

U.S. Pat. No. 5,576,601 (Koenck et al) acknowledges that it is known in the art to apply power to an electroluminescent panel through the secondary output of an autotransformer coupled in series with the electroluminescent panel. The inductance of the autotransformer is configured with respect to the capacitance of the electroluminescent panel to provide a resonant frequency at the desired operating frequency of the electroluminescent panel. However, there is no teaching of any mechanism for accommodating quickly changing load variations during gray scale scanning. A capacitor is provided to prevent the panel from voltage spikes, which is problematic for thin film electroluminescent panels. The present invention relates to thick film panels that are characterized by much higher dielectric breakdown voltages.

U.S. Pat. No. 3,749,977 (Sliker) relates to drive circuitry for electroluminescent lamps. A transformer with split secondary is disclosed. However, there is no suggestion of providing voltage regulation with a varying load.

JP 11067447 (Okada) also relates to drive circuitry for electroluminescent lamps, which do not experience fluctuations in load or are in any way concerned with gray scale variation of displays.

U.S. Pat. No. 4,866,349 (Weber et al) relates to plasma panels and other panels where the drive circuitry is required to provide sustained arc current to provide luminance.

U.S. Pat. No. 5,517,089 (Ravid) teaches an electroluminescent panel with a transformer. However, there is no suggestion of resonant circuits or gray scale control.

SUMMARY OF THE INVENTION

According to the present invention, a method and apparatus are provided to regulate the maximum value of the sinusoidal voltage waveform provided to the rows and columns of a flat panel display even though the capacitance of the panel as seen through the rows and columns may vary substantially. Regulation is effected by clamping the voltage to a substantially fixed value when the voltage to the rows or columns exceeds a predetermined value. The predetermined value is chosen to be the peak sinusoidal voltage in the absence of clipping when the panel capacitance as seen through the rows or columns is effectively near its maximum value. This voltage clamping feature facilitates gray scale control by providing a regulated voltage independent of the panel capacitance for any desired input voltage level up to that for maximum display luminance.

DESCRIPTION OF THE PREFERRED EMBODIMENTS

Figure 6:
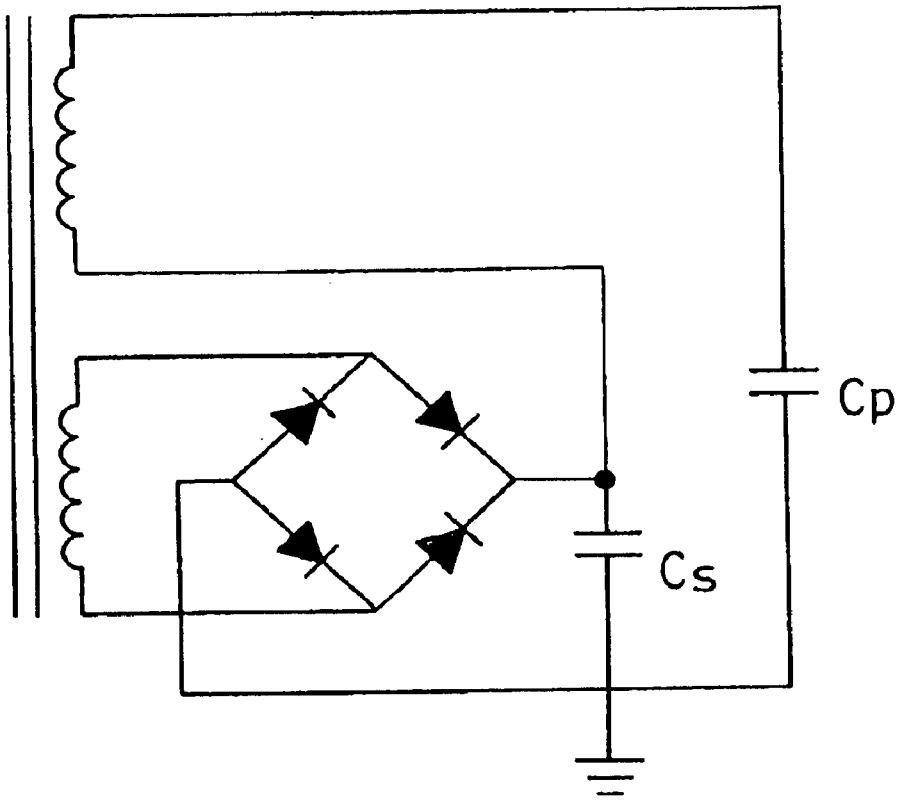
FIG. 6 is a simplified schematic of a transformer secondary side portion of a display driver incorporating the elements of the present invention.

According to the present invention in its broadest aspect, a secondary winding on the step-down transformer T of FIG. 4 is connected to a full wave rectifier with a large storage capacitor connected across its output. The storage capacitor $C_S$ and the panel capacitor $C_P$ are connected in series as shown in FIG. 6. The turns ratio of the secondary winding connected to the to full wave rectifier and storage capacitor $C_S$ to that of the second secondary winding connected to the panel is at least 1.05:1, preferably at least 1.1:1 and more preferably in the range 1.1:1 to 1.2:1. The turns ratio for the secondary windings of the present invention is substantially larger than the turns ratio of the three turn secondary winding connected to the panel in the energy recovery circuit of FIG. 4 (i.e. that of U.S. patent application Ser. No. 09/504,472). The 3-turn winding in that circuit was designed to provide a small DC offset to the voltage input to the row and column drivers to ensure their proper operation. The capacitance of the storage capacitor $C_S$ is very large relative to the panel capacitance $C_P$. Since the full wave rectifier ensures that the voltage across the storage capacitor always has the same polarity, a large capacitance can be achieved in a small volume through use of an electrolytic capacitor. Other high energy density capacitors such as tantalum or ruthenium oxide super-capacitors may also be used.

In operation the voltage applied to the panel is clamped at a value that can be arbitrarily set by adjusting feedback to the pulse width modulator (PWM). For a heavy panel load where the panel capacitance $C_P$ is near its maximum value, approximately 90% of the energy is arranged to flow to the secondary winding connected to the panel for charging the panel, and the remaining 10% charges the storage capacitor $C_P$. For an average load where the panel capacitance has an average value, approximately 50% of the energy is directed to charge the panel and 50% is directed to the storage capacitor $C_S$. For a light load with the panel capacitance $C_P$ near a minimum approximately 10% of the energy is directed to the panel and 90% to the storage capacitor. Typically these conditions can be met if the voltage at the panel is always positive with a minimum value of about 0.5 volts to ensure proper operation of switching ICs connecting to the rows and columns of the display. Also, the ratio of the capacitance of the storage capacitor to the maximum panel capacitance should be at least about 10:1 and preferably at least about 20:1, and most preferably at least 30:1.

The internal series resistance of the storage capacitor $C_S$ is chosen to be sufficiently low that voltage fluctuations across the capacitor due to resistive losses and the RC time constant do not exceed the specified regulation tolerance. Also, the turns ratio for the two secondary windings should take into account the forward voltage drop across the diodes in the rectifier that drive the storage capacitor and any resistive loss in the secondary circuits. The forward diode voltage drop can be minimized by selecting Schottky diodes for the rectifier.

During operation of the circuit according to FIG. 6, when a voltage pulse below the clamp voltage is applied to a row or column, energy from the primary winding is transferred mainly through the secondary winding connected across the panel. At the same time, energy from the storage capacitor $C_S$ flows to the panel, When the voltage exceeds the clamp voltage, energy is mainly transferred to both the storage and panel capacitors from the primary winding through the secondary winding connected to the rectifier in such a way that the storage and panel capacitors are charged in parallel. Since the parallel capacitance is dominated by the large capacitance of the storage capacitor $C_S$, there is only minimal increase in the voltage across the capacitors, and effective voltage regulation is achieved.

Longer term drift of the voltage across the storage capacitor $C_S$ over many pulses due to random changes in the displayed image can be eliminated by sensing the average voltage over many addressing cycles and providing feedback to the primary circuit, as set forth in U.S. patent application Ser. No. 09/504,742. Thus, both short-term voltage fluctuations on the time scale of a single pulse and longer-term voltage fluctuations can be minimized to the extent required to maintain gray scale fidelity.

Figure 7:
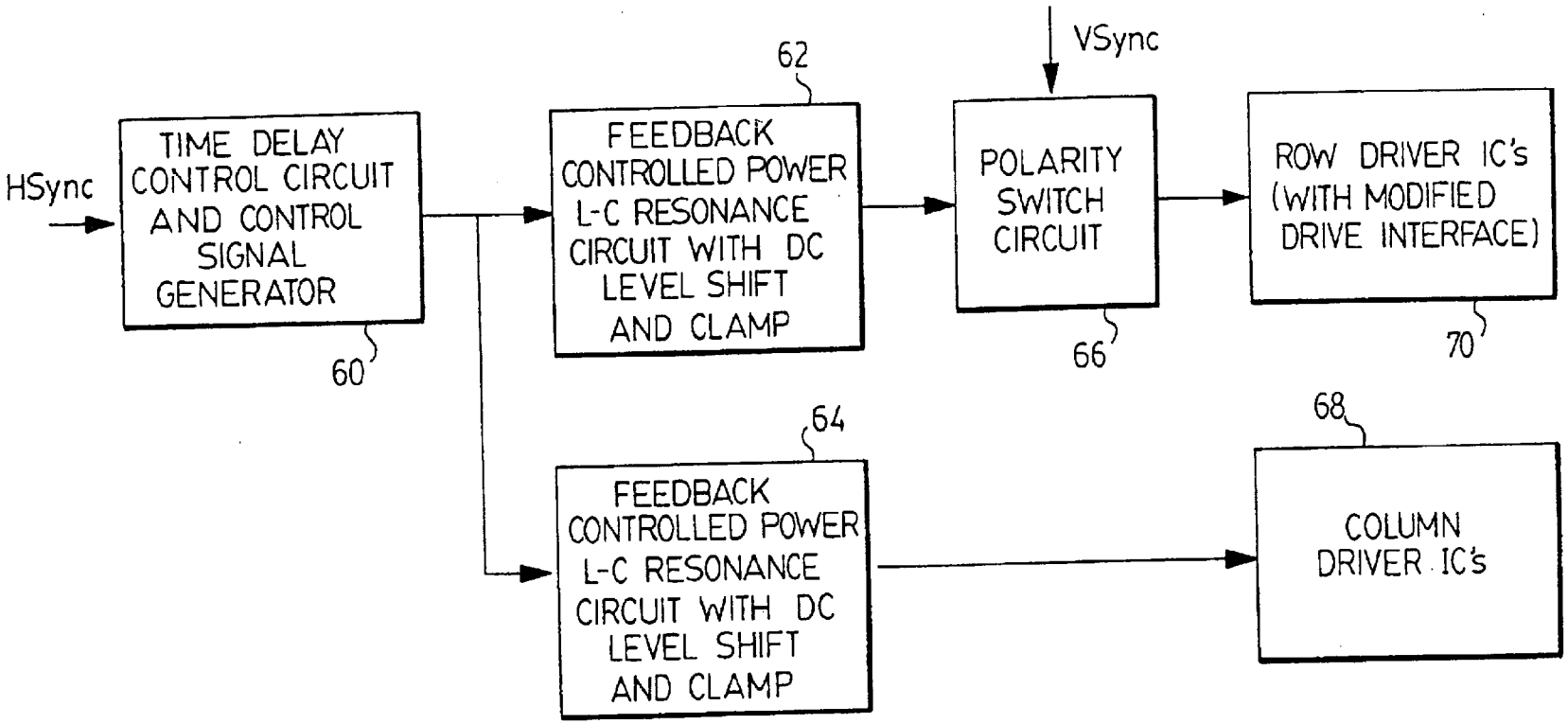
FIG. 7 is a block diagram of a driver circuit incorporating the elements of the present invention.

A block diagram of a complete display driver is shown in FIG. 7. In the diagram HSync refers to timing pulses that initiate addressing of a single row. The HSync pulses are fed to a time delay control circuit 60 where the delay time is set so that the zero current times in the resonant circuit will correspond to the switching times for the rows and columns. The output of circuit 60 is applied to row and column resonant circuits 62 and 64, and the output of circuit 62 is applied to polarity switching circuit 66. The switching times for the polarity switching circuit 66 are controlled by the VSync pulses to control the timing for initiating each complete frame. The outputs of circuits 64 and 66 are clamped as described in greater detail below, and applied to the column and row driver ICs 68 and 70, respectively.

Returning momentarily to FIG. 2, the preferred embodiment for the present invention is optimized for use with an electroluminescent display having a thick film dielectric layer. Thick film electroluminescent displays differ from conventional thin film electroluminescent displays in that one of the two dielectric layers comprises a thick film layer having a high dielectric constant. The second dielectric layer is not required to withstand a dielectric breakdown since the thick layer provides this function, and can be made substantially thinner than the dielectric layers employed in thin film electroluminescent displays. U.S. Pat. No. 5,432,015 teaches methods to construct thick film dielectric layers for these displays. As a result of the nature of the dielectric layers in thick film electroluminescent displays, the values in the equivalent circuit shown in FIG. 3 are substantially different than those for thin film electroluminescent displays. In particular, the values for $C_d$ can be significantly larger than they are for thin film electroluminescent displays. This makes the variation in panel capacitance as a function of the applied row and column voltages greater than it is for thin film displays, and provides a greater impetus for the use of the present invention in thick film displays. The ratio of the pixel capacitance above the threshold voltage to that below the threshold voltage is typically about 4:1 but can exceed 10:1. By contrast, for thin film electroluminescent displays this ratio is in the range of about 2:1 to 3:1. Typically the panel capacitance can range from the nanofarad range to the microfarad range, depending on the size of the display and the voltages applied to the rows and columns.

A row driver circuit and a column driver circuit have been built according to a successful reduction to practice of the present invention, for an 8.5 inch 240 by 320 pixel quarter VGA format diagonal thick film colour electroluminescent display. Each pixel has independent red, green and blue sub-pixels addressed through separate columns and a common row. The threshold voltage for the prototype display was 150 volts. The panel capacitance for this display measured at an applied voltage of less than 10 volts between a row and the columns with all of the columns at a common potential was 7 nanofarads. The panel capacitance measured at a similar voltage between a row and a column but with half of the remaining columns at a common potential with the selected column and the remaining columns at a voltage of 60 volts with respect to the selected column was 0.4 microfarads, a much larger value.

Figure 8:
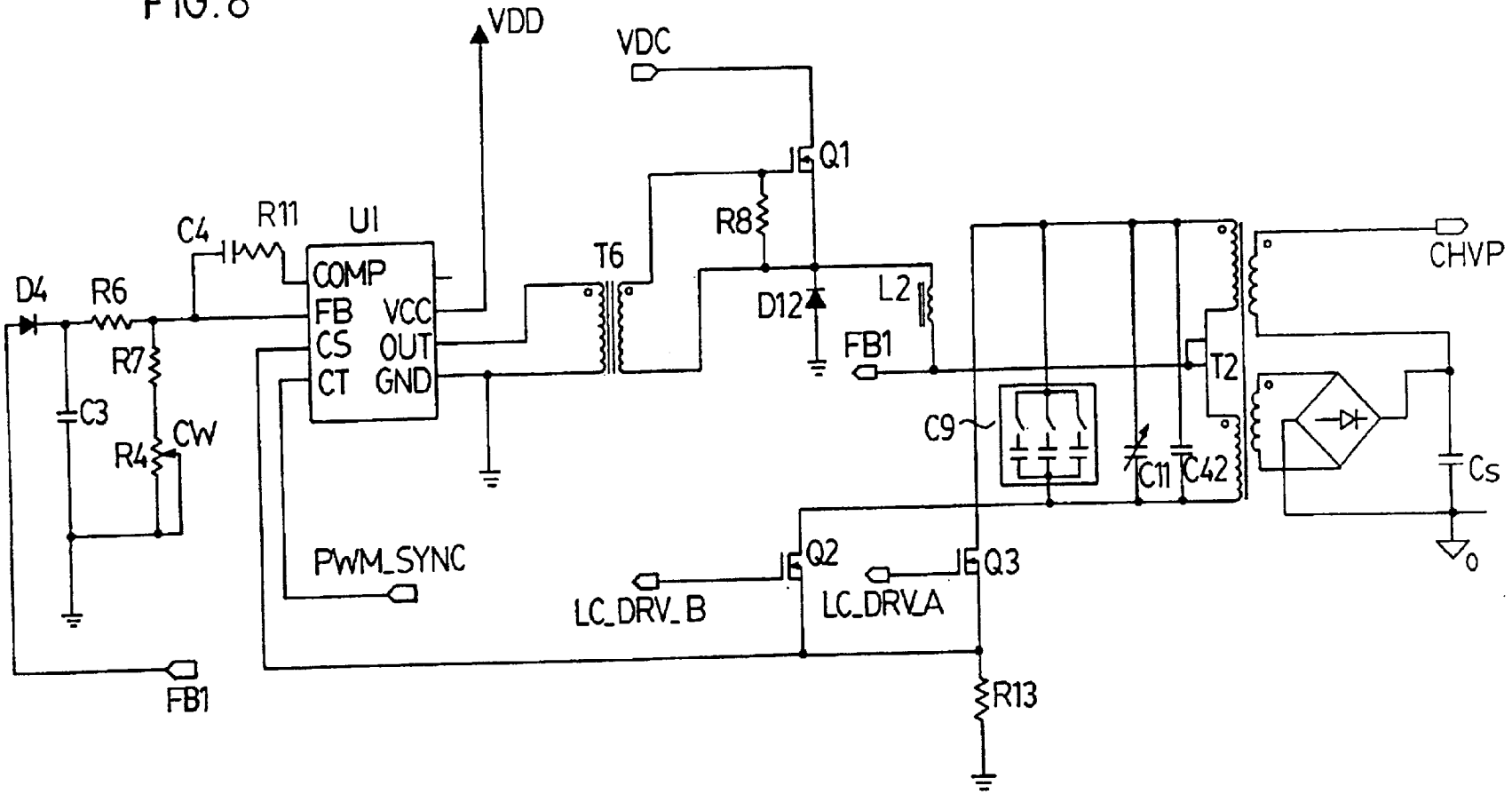
FIG. 8 is a detailed circuit diagram of a column driver according to the preferred embodiment of the present invention.
Figure 9:
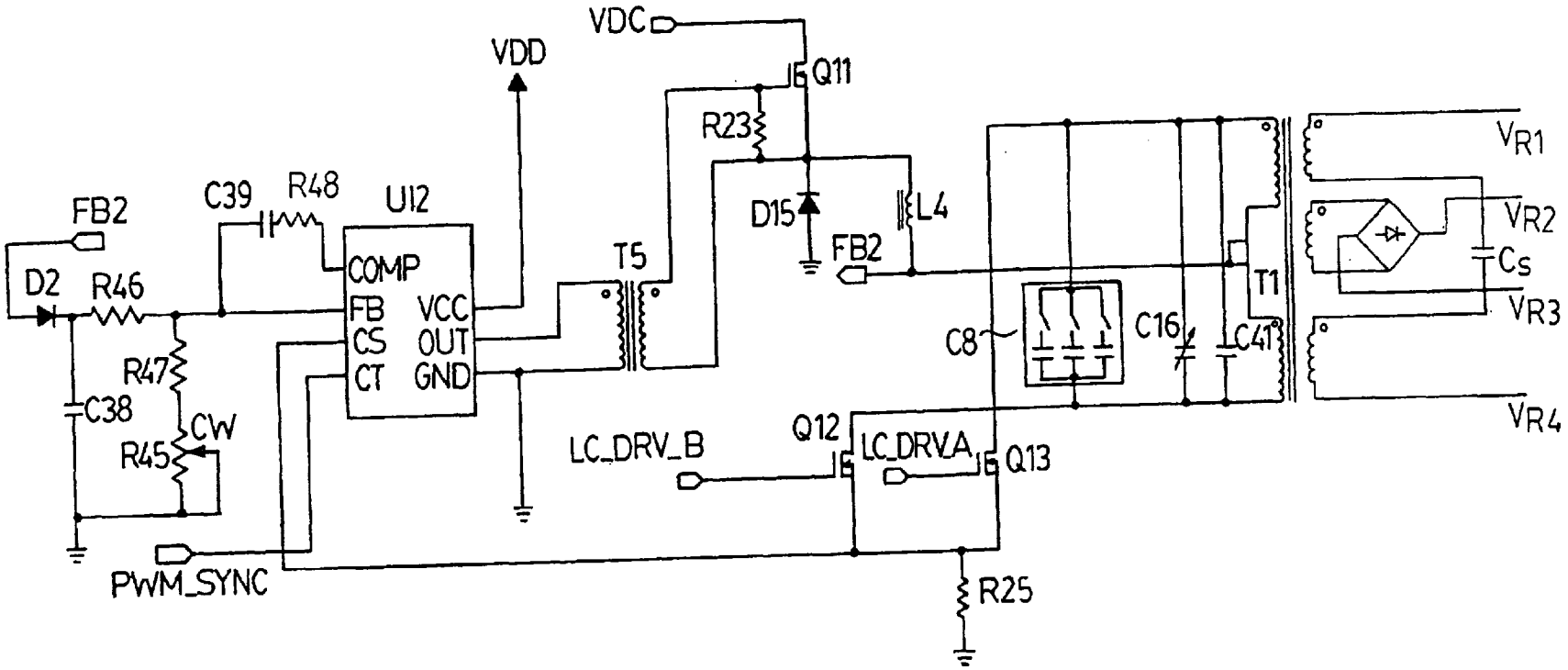
FIG. 9 is a detailed circuit diagram of a row driver according to the preferred embodiment of the present invention.
Figure 10:
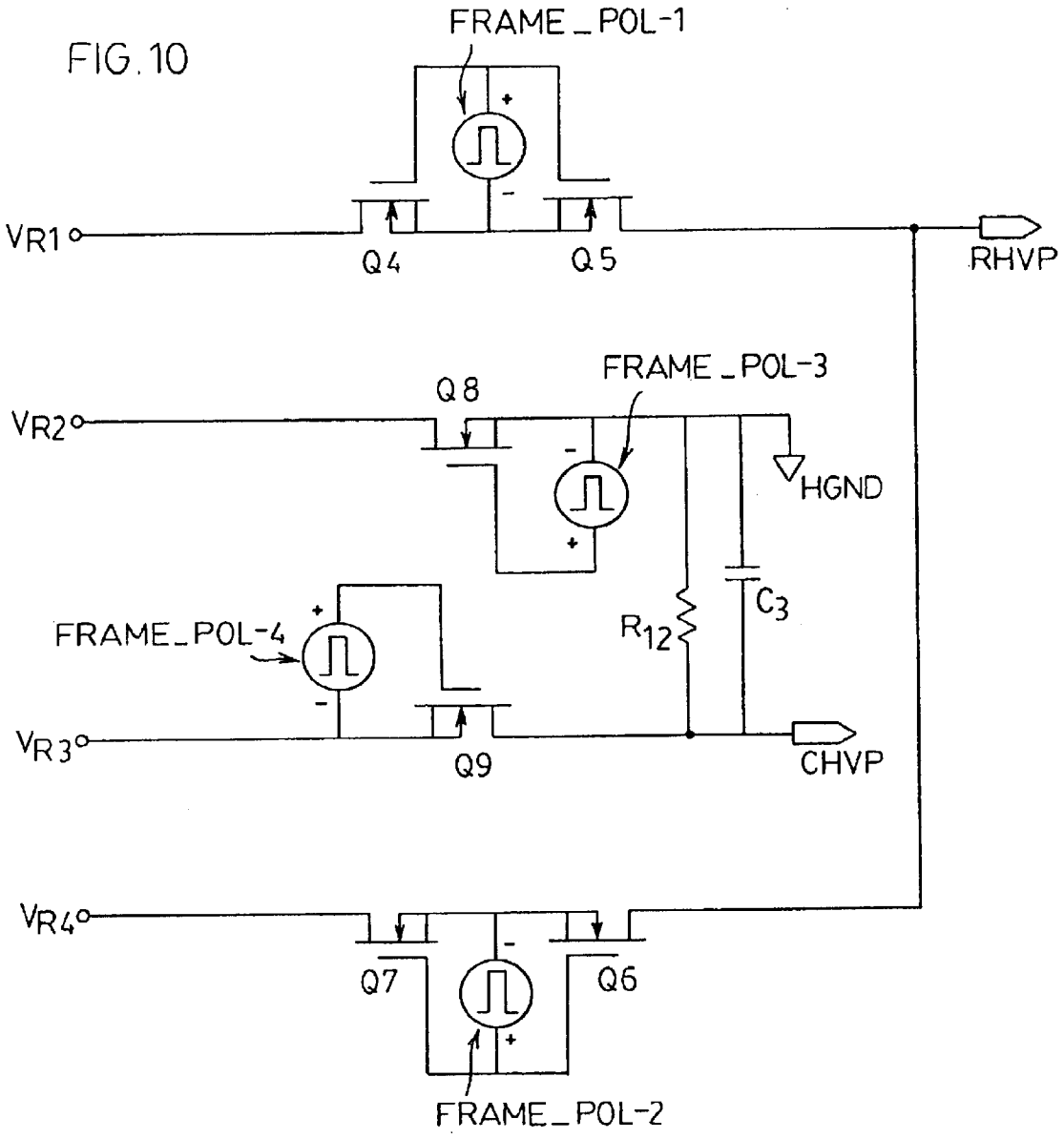
FIG. 10 is a detailed circuit diagram of a polarity reversing circuit employed at the output of the row driver of FIG. 9.

FIGS. 8 and 9 are circuit schematics for the resonant circuits according to a preferred embodiment of the present invention used for columns and rows, respectively. FIG. 10 is a circuit schematic of a polarity reversing circuit connected between the row resonant circuit and the row drivers to provide alternating polarity voltage to the row driver high voltage input pins. The input DC voltage to the resonant circuits was 330 volts (rectified off-line from 120/240 volts AC). The output of the polarity reversing circuit is connected to the high voltage input pins of the row driver IC 70 (FIG. 7), the output pins of which are connected to the rows of the display. The clock and gate input pins of the row drivers are synchronized using digital circuitry employing field programmable gate arrays (FPGA's) adapted for matrix addressing of electroluminescent displays, as known in the art.

Figure 11:
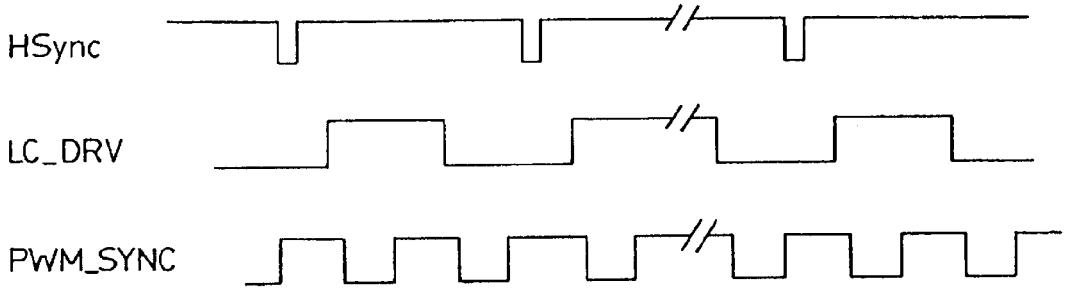
FIG. 11 and FIG. 12 are timing diagrams showing display timing pulses used in the display driver of the present invention.
Figure 12:
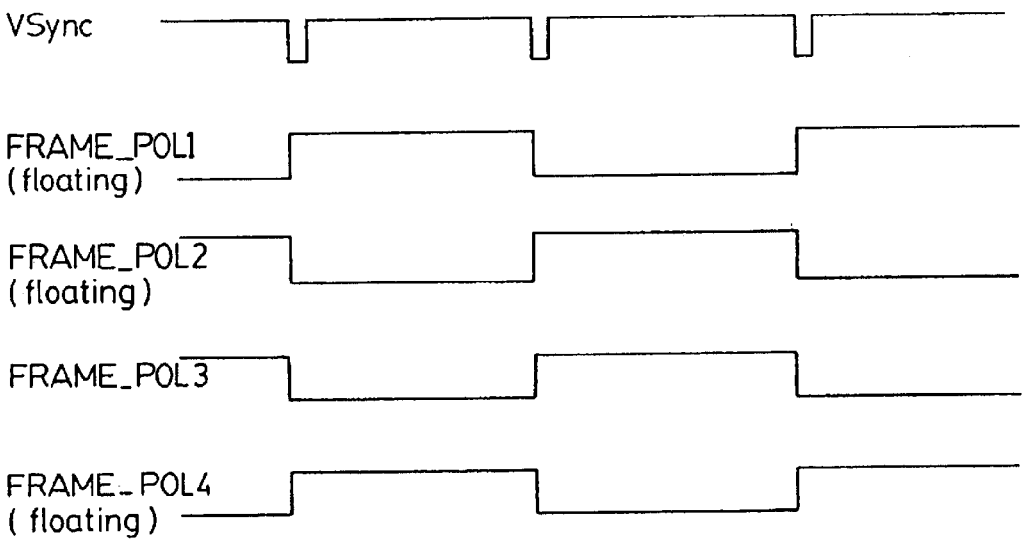

FIG. 11 and FIG. 12 shows the timing signal waveforms that are used to control the inventive driver circuit, as shown in FIGS. 7, 8, 9 and 10. The row addressing frequency for the prototype display was 32 kHz, allowing a refresh rate of 120 Hz for the display.

With reference to FIG. 8, the resonant frequency of the column driving resonant circuit is controlled by the effective inductance seen at the primary of the step-down transformer T2 and by the effective capacitance of the capacitor C42 in parallel with the column capacitance as seen at the primary of T2. There is also a small trimming capacitor C11 in parallel with C42 for fine tuning of the resonant frequency. The turns ratio for the transformer is greater than 5 and the value $C_I$ of the capacitor C42, with reference to equation 2, is chosen so that $C_I$ is substantially greater than $(n_2/n_1)^2\ C_P$ to minimize the effect of changes in the panel capacitance on the resonant frequency. C9 is a bank of capacitors for tuning the tank circuit, in conjunction with the capacitance of C42, to obtain the desired resonant frequency to match or synchronize with different display scanning frequencies.

With further reference to FIG. 8, the sinusoidal output at the secondary of the transformer T2 is DC shifted by the voltage across the storage capacitor $C_S$ of the clamp circuit so that the instantaneous output voltage is never negative.

The resonant circuit is driven using the two MOSFETs Q2 and Q3, the switching of which is controlled by the LC DRV signal that is synchronized using an appropriate delay time with the HSync signal thereby causing the row driver ICs to select the addressed row. The delay is adjusted to ensure that switching of the row driver ICs occurs when the drive current is close to zero. The LC DRV signal is generated by the low voltage logic section of the display driver that is typically a field programmable gate array (FPGA) but may be an application specific integrated circuit (ASIC) designed for this purpose. The LC DRV signal is a 50% duty cycle TTL level square wave. The LC DRV signal has two forms: the LC DRV A signal is the complementary of the LC DRV B signal.

Again with respect to FIG. 8, control of the voltage level in the resonant circuit is achieved using the pulse width modulator U1 whose output is routed through the transformer T6 to the gate of the MOSFET Q1. This controls the voltage level in the resonant circuit by chopping the 330 volt input DC voltage. The inductor L2 limits the current to the resonant circuit as it is being energized from the DC voltage and the diode D12 limits voltage excursions at the source of the MOSFET Q1 due to current changes in the inductor. The duty cycle for the pulse width modulator is controlled by a voltage feedback circuit for sensing the voltage at the primary of the transformer T2 to regulate or adjust the resonant circuit voltage. The switching of the pulse width modulator is synchronized with HSync using the TTL signal PWM_SYNC from the low voltage logic section of the display driver.

With reference to FIG. 9, the operation of the row driver circuit for the preferred embodiment is similar to that of the column driver circuit, except that the turns ratio on the transformer T1 as compared to that of the transformer T2 in the column driver circuit is different to reflect the higher row voltages and smaller values of the panel capacitance as seen through the rows, due to the fact that the remaining rows are at open circuit. There are also four more secondary windings on the transformer Ti than there are on T2 to generate floating voltages required for operation of the polarity reversing circuit that alternates the polarity of the rows on successive frames.

In the preferred embodiment, the output of the row driver circuit feeds into the polarity reversing circuit shown in FIG. 10. This provides row voltages having opposite polarity on alternate frames to provide the required ac operation of the electroluminescent display. Six MOSFETs Q4 through Q9 form a set of analogue switches connecting either the positive or the negative sinusoidal drive waveforms generated to the panel rows. The selection of polarity is controlled by FRAME POL, a TTL signal generated by the system logic circuit in the display system. The FRAME POL signal is synchronized to the vertical synchronization signal VSYNC that initiates scanning of each frame on the display. The FRAME POL signal, together with four floating voltages from T1, generates the control signals (FRAME_POL-1 to FRAME_POL-4) that operate the polarity reversing circuit.

Although alternate embodiments of the invention have been described herein, it will be understood by those skilled in the art that variations may be made thereto without departing from the spirit of the invention or the scope of the appended claims.

What is claimed is:

1. A driving circuit for providing regulated power with gray scale image control of an electroluminescent display using energy recovered from a varying panel capacitance ($C_p$) of said display, comprising:

a source of electrical energy;

a resonant circuit using said panel capacitance ($C_p$), for receiving said electrical energy and in response generating a sinusoidal voltage to power said display at a resonance frequency which is substantially synchronized to a scanning frequency of said display, wherein said resonant circuit further comprises a step down transformer for reducing the effective panel capacitance ($C_p$) of said display; and a circuit for regulating the maximum value of said sinusoidal voltage in the event of variations in said panel capacitance ($C_p$).

2. The driving circuit of claim 1, wherein said step down transformer has a primary winding across which a further capacitance ($C_1$) is connected; a first secondary winding across which said panel capacitance ($C_p$) is connected, wherein the value of said further capacitance ($C_1$) is sufficiently large relative said panel capacitance ($C_p$) to maintain substantial synchronization of said resonance frequency to said scanning frequency; and a further secondary winding connected to a full wave rectifier with a storage capacitor ($C_s$) connected thereacross and in series with said panel capacitance ($C_p$) wherein the value of said storage capacitor ($C_s$) is sufficiently large relative said panel capacitance ($C_p$) that (i) for a heavy panel load where the panel capacitance ($C_p$) is at or near its maximum value most of said electrical energy flows to the first secondary winding for charging the panel and remaining energy charges the storage capacitor ($C_s$), (ii) for an average load where the panel capacitance has an average value approximately half of the energy flows to the panel and half of the energy flows to the storage capacitor ($C_s$), and (iii) for a light load where the panel capacitance is at or near a minimum value most of the energy flows to the storage capacitor and remaining energy flows to the panel.

3. The driving circuit of claim 2, wherein the ratio of the capacitance of the storage capacitor ($C_s$) to the maximum panel capacitance is at least about 10:1.

4. The driving circuit of claim 3, wherein the ratio of the capacitance of the storage capacitor ($C_s$) to the maximum panel capacitance is at least about 20:1.

5. The driving circuit of claim 4, wherein the ratio of the capacitance of the storage capacitor ($C_s$) to the maximum panel capacitance is at least about 30:1.

6. The driving circuit of claim 2, wherein said full save rectifier incorporates Schottky diodes for minimizing forward diode voltage drop.

7. The driving circuit of claim 2, the turns ratio of the further secondary winding to that of the first second secondary winding is at least 1.05:1.

8. The driving circuit of claim 2, wherein the turns ratio of the further secondary winding to that of the first second secondary winding is at least 1.1:1.

9. The driving circuit of claim 8, wherein the turns ratio of the further secondary winding to that of the first second secondary winding is in the range 1.1:1 to 1.2:1.

10. The driving circuit of claim 2, wherein said primary winding has $n_1$, turns and said secondary winding has $n_2$ turns such that $C_1 >> (n_2/n_1)^2 \times C_p$.

11. The driving circuit of claim 2, comprising an additional capacitor for changing said resonance frequency.

12. A driving circuit for providing regulated power with gray scale image control of an electroluminescent display using energy recovered from a varying panel capacitance ($C_p$) of said display, comprising:

a source of electrical energy, wherein the source further comprises voltage means for generating a direct current voltage; and a pulse width modulator for chopping said direct current voltage into pulses of electrical energy;

a resonant circuit using said panel capacitance ($C_p$), for receiving said electrical energy arid in response generating a sinusoidal voltage to power said display at a resonance frequency which is substantially synchronized to a scanning frequency of said display; and a circuit for regulating the maximum value of said sinusoidal voltage in the event of variations in said panel capacitance ($C_p$).

13. A driving circuit for providing regulated power with gray scale image control of an electroluminescent display using energy recovered from a varying panel capacitance ($C_p$) of said display, comprising:

a source of electrical energy;

a resonant circuit using said panel capacitance ($C_p$), for receiving said electrical energy and in response generating a sinusoidal voltage to power said display at a resonance frequency which is substantially synchronized to a scanning frequency of said display;

a circuit for regulating the maximum value of said sinusoidal voltage in the event of variations in said panel capacitance ($C_p$); and a controller for controlling the rate of electrical energy received by said resonant circuit to control fluctuations of said sinusoidal voltage due to a varying impedance of said display and energy usage by said display.

14. The driving circuit of claim 13, said controller further comprises a feedback circuit for sensing fluctuations of said sinusoidal voltage using an input from said resonant circuit and in response providing a feedback signal to said controller.

15. The driving circuit of claim 14, wherein said input is from a primary winding of a step down transformer of said resonant circuit.

16. The driving circuit of claim 15, wherein said sinusoidal voltage is clamped at a predetermined value by adjusting said feedback signal to said controller.

17. A passive matrix display comprising:

a plurality of rows adapted to be scanned at a predetermined scanning frequency of said display;

a plurality of columns which intersect said rows to form a plurality of pixels characterized by a varying panel capacitance ($C_p$);

a source of electrical energy;

a resonant circuit using said panel capacitance ($C_p$), for receiving said electrical energy and in response generating a sinusoidal voltage to power said display at a resonance frequency which is substantially synchronized to the scanning frequency of said display, wherein said resonant circuit further comprises a step down transformer for reducing the effective panel capacitance ($C_p$) of said display; and a circuit for regulating the maximum value of said sinusoidal voltage in response to variations in said panel capacitance ($C_p$).

18. The passive matrix display of claim 17, wherein said step down transformer has a primary winding across which a further capacitance ($C_1$) is connected; a first secondary winding across which said panel capacitance ($C_p$) is connected, wherein the value of said further capacitance ($C_1$) is sufficiently large relative said panel capacitance ($C_p$) to maintain substantial synchronization of said resonance frequency to said scanning frequency; and a further secondary winding connected to a full wave rectifier with a storage capacitor ($C_s$) connected thereacross and in series with said panel capacitance ($C_p$) wherein the value of said storage capacitor ($C_s$) is sufficiently large relative said panel capacitance ($C_p$) that (i) for a heavy panel load where the panel capacitance ($C_p$) is at or near its maximum value most of said electrical energy flows to the first secondary winding for charging the panel and remaining energy charges the storage capacitor ($C_s$), (ii) for an average load where the panel capacitance has an average value approximately half of the energy flows to the panel and half of the energy flows to the storage capacitor ($C_s$), and (iii) for a light load where the panel capacitance is at or near a minimum value most of the energy flows to the storage capacitor and remaining energy flows to the panel.

19. The passive matrix display of claim 18, wherein the ratio of the capacitance of the storage capacitor ($C_s$) to the maximum panel capacitance is at least about 10:1.

20. The passive matrix display of claim 19, wherein the ratio of the capacitance of the storage capacitor ($C_s$) to the maximum panel capacitance is at least about 20:1.

21. The passive matrix display of claim 20, wherein the ratio of the capacitance of the storage capacitor ($C_s$) to the maximum panel capacitance is at least about 30:1.

22. The passive matrix display of claim 18, wherein said full wave rectifier incorporates Schottky diodes for minimizing forward diode voltage drop.

23. The passive matrix display of claim 18, wherein the turns ratio of the further secondary winding to that of the first second secondary winding is at least 1.05:1.

24. The passive matrix display of claim 18, wherein the turns ratio of the further secondary winding to that of the first second secondary winding is at least 1.1:1.

25. The passive matrix display of claim 24, wherein the turns ratio of the further secondary winding to that of the first second secondary winding is in the range 1.1:1 to 1.2:1.

26. The passive matrix display of claim 18, wherein said primary winding has $n_1$ turns and said secondary winding has $n_2$ turns such that $C_1 >> (n_2/n_1)^2 \times C_p$.

27. The passive matrix display of claim 18, further comprising an additional capacitor for changing said resonance frequency.

28. A passive matrix display comprising:

a plurality of rows adapted to be scanned at a predetermined scanning frequency of said display;

a plurality of columns which intersect said rows to form a plurality of pixels characterized by a varying panel capacitance ($C_p$);

a source of electrical energy, wherein the source further comprises voltage means for generating a direct current voltage; and a pulse width modulator for chopping said direct current voltage into pulses of electrical energy;

a resonant circuit using said panel capacitance ($C_p$), for receiving said electrical energy and in response generating a sinusoidal voltage to power said display at a resonance frequency which is substantially synchronized to the scanning frequency of said display; and a circuit for regulating the maximum value of said sinusoidal voltage in response to variations in said panel capacitance ($C_p$).

29. A passive matrix display comprising:

a plurality of rows adapted to be scanned at a predetermined scanning frequency of said display;

a plurality of columns which intersect said rows to form a plurality of pixels characterized by a varying panel capacitance ($C_p$);

a source of electrical energy;

a resonant circuit using said panel capacitance ($C_p$), for receiving said electrical energy and in response generating a sinusoidal voltage to power said display at a resonance frequency which is substantially synchronized to the scanning frequency of said display;

a circuit for regulating the maximum value of said sinusoidal voltage in response to variations in said panel capacitance ($C_p$); and a controller for controlling the rate of electrical energy received by said resonant circuit to control fluctuations of said sinusoidal voltage due to a varying impedance of said display and energy usage by said display.

30. The passive matrix display of claim 29, wherein said controller further comprises a feedback circuit for sensing fluctuations of said sinusoidal voltage using an input from said resonant circuit and in response providing feedback signal to said controller.

31. The passive matrix display of claim 30, wherein said input is from a primary winding of a step down transformer of said resonant circuit.

32. The passive matrix display of claim 31, wherein said sinusoidal voltage is clamped at a predetermined value by adjusting said feedback signal to said controller.

* * * * *